US005231917A

United States Patent [19]

Wood

[11] Patent Number: 5,231,917

[45] Date of Patent: Aug. 3, 1993

[54] WOBBLE PISTON

[75] Inventor: Mark W. Wood, Jackson, Tenn.

[73] Assignee: DeVilbiss Air Power Company, Jackson, Tenn.

[21] Appl. No.: 944,400

[22] Filed: Sep. 14, 1992

[51] Int. Cl.[5] ..... F01B 31/08

[52] U.S. Cl. ..... 92/186; 92/240

[58] Field of Search ..... 92/158, 159, 186, 240, 92/255

[56] References Cited

U.S. PATENT DOCUMENTS

| | | | |
|---|---|---|---|
| 1,115,176 | 10/1914 | Daniel . | |
| 1,226,631 | 5/1917 | Bie . | |
| 2,042,673 | 6/1986 | Maniscalco | 230/211 |
| 2,058,485 | 10/1936 | Miller | 230/221 |
| 2,092,920 | 9/1937 | Johnson | 230/174 |
| 2,361,316 | 10/1944 | Newton et al. | 230/179 |
| 4,304,173 | 12/1981 | Brille | 74/60 |
| 4,577,595 | 3/1986 | Deutschman et al. | 123/41.35 |
| 4,995,795 | 2/1991 | Hetzel et al. | 417/571 |

*Primary Examiner*—Edward K. Look
*Assistant Examiner*—F. Daniel Lopez
*Attorney, Agent, or Firm*—MacMillan, Sobanski & Todd

[57] ABSTRACT

An improved wobble piston for an air compressor. The piston has a head integrally connected to a connecting rod. The connecting rod has a free end for connection to a rotating eccentric. The piston head has an internal chamber. Openings are formed through the piston head into the chamber on opposite sides of the connecting rod in a plane perpendicular to the eccentric axis. The location of the chamber openings establishes a flow of cooling air through the chamber as the piston is reciprocated in a cylinder.

5 Claims, 2 Drawing Sheets

WOBBLE PISTON

TECHNICAL FIELD

The invention relates to pistons for reciprocating piston air compressors and more particularly to an improved air cooled wobble piston for an air compressor.

BACKGROUND ART

Two types of pistons are used in reciprocating piston air compressors. In a first piston design, the piston has a cylindrical shape and is confined to slide in a cylinder without rotating relative to the cylinder. A connecting rod has an end connected to the piston and has a free end connected to a rotating eccentric. Since the piston cannot rotate with the connecting rod, it is necessary to provide a hinge connection between the connecting rod and the piston through the use of a wrist pin. In order for the compressor to operate, oil lubrication must be provided for the reciprocating piston. The oil also may be sprayed at the bottom of the piston and in chambers inside the piston for cooling. Although the piston may have internal chambers in which cooling oil is sprayed or circulated and to reduce the weight of the piston, there is essentially no induced air flow through the piston because the linear reciprocation of the piston establishes a uniform air pressure across the bottom of the piston.

A second common piston design does not require oil lubrication. The piston is rigidly secured to the connecting rod. The piston is provided with a sufficiently thin profile to allow the piston to wobble or rock in the cylinder with the connecting rod as the piston is reciprocated. A resilient seal is provided around the periphery of the piston to allow the piston to tilt in the cylinder without loss of a gas tight seal between the piston and the cylinder. The sliding seal and a smooth coating on the cylinder reduce friction so that oil lubrication is not required.

The service life of a wobble piston compressor is often limited by the life of the piston seal. Many factors have been found to affect the seal life. In general, seal life is improved both by reducing friction between the seal and the cylinder band by reducing the temperature of the seal. Since heat is released when air is compressed, it has been found important to cool the cylinder and the piston as much as possible to enhance seal life.

The operating efficiency of a compressor also can be degraded by heat. For strength while minimizing weight, the prior rt piston typically has been formed as a relatively thick aluminum casting. Heat absorbed by the piston during the compression stroke is transferred from the piston top to air drawn into the cylinder during the subsequent intake stroke. This causes the air to expand and consequently reduces the volumetric efficiency of the compressor.

DISCLOSURE OF INVENTION

The invention is directed to a wobble piston having improved cooling. The piston is formed with an internal cavity which is closed by a cap. The cap, which is exposed to the compressed air, is thinner than prior art pistons to reduce the thermal resistance and enhance heat transfer form the compression chamber. Two vent openings are formed in the bottom of the piston on opposite sides of the connecting rod. The vent openings are located in a plane perpendicular to the axis of the eccentric so that the vent openings rotate relative to each other as the piston rotates. This causes a pressure differential between the two vent openings which in turn establishes an air flow through the internal piston chamber to cool the piston and particularly to cool the piston cap. The cooling air flow both reduces the piston seal temperature and increases the volumetric efficiency of the compressor.

Accordingly, it is an object of the invention to provide an improved wobble piston or a reciprocating piston air compressor.

Other objects and advantages of the invention will become apparent from the following detailed description of the invention and the accompanying drawings.

BEST MODE FOR CARRYING OUT THE INVENTION

Figure 1:
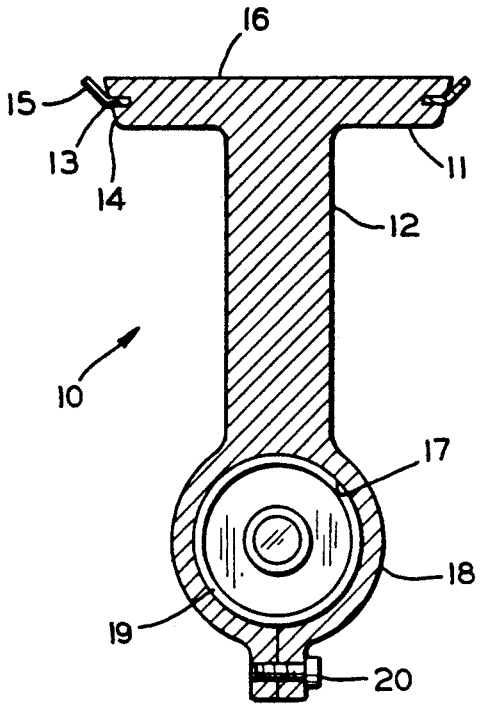
FIG. 1 (PRIOR ART)
FIG. 1 is a cross sectional view through a typical prior art wobble piston for an air compressor.

Referring to FIG. 1 of the drawings, an exemplary prior art wobble piston 10 is illustrated in section. The piston 10 includes a head 11 and an integral connecting rod 12. The head 11 and connecting rod 12 are typically cast from a strong light weight material such as an aluminum alloy. The head 11 has a generally flat circular configuration with a groove 13 formed in its periphery 14 for receiving a cup shaped ring or seal 15. The head 11 must have sufficient thickness to withstand the pressures exerted by compressed air on the head 11. The needed thickness of the head 11 presents a relatively high thermal resistance which transfers an unnecessarily high amount of heat to the seal 15 and to intake air contacting a top surface 16 of the piston head 11. The periphery 14 may be slightly conical to provide clearance when the piston head 11 tilts in a cylinder (not shown). A circular opening 17 is formed in a free end 18 of the connecting rod 12. An eccentric bearing 19 is clamped in the opening 17 by a screw 20.

Figure 2:
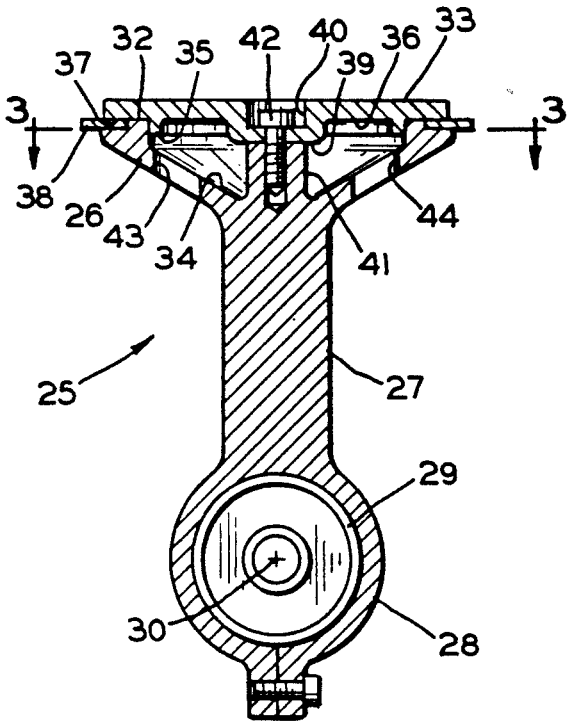
FIG. 2 is a cross sectional view through an improved air cooled wobble piston for an air compressor in accordance with the invention.
Figure 3:
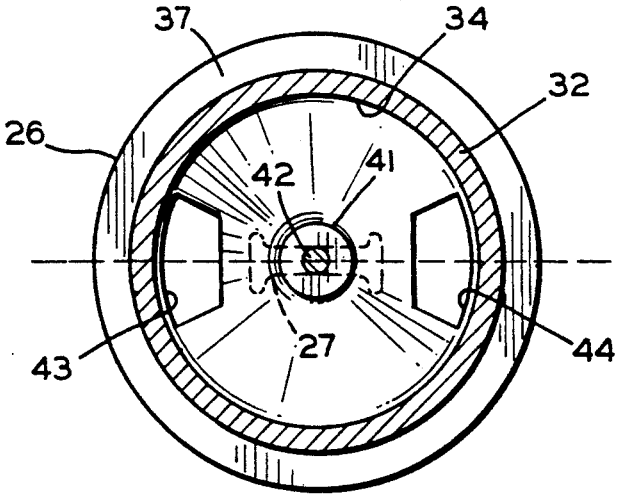
FIG. 3 is a cross sectional view taken along line 3—3 of FIG. 2.
Figure 4:
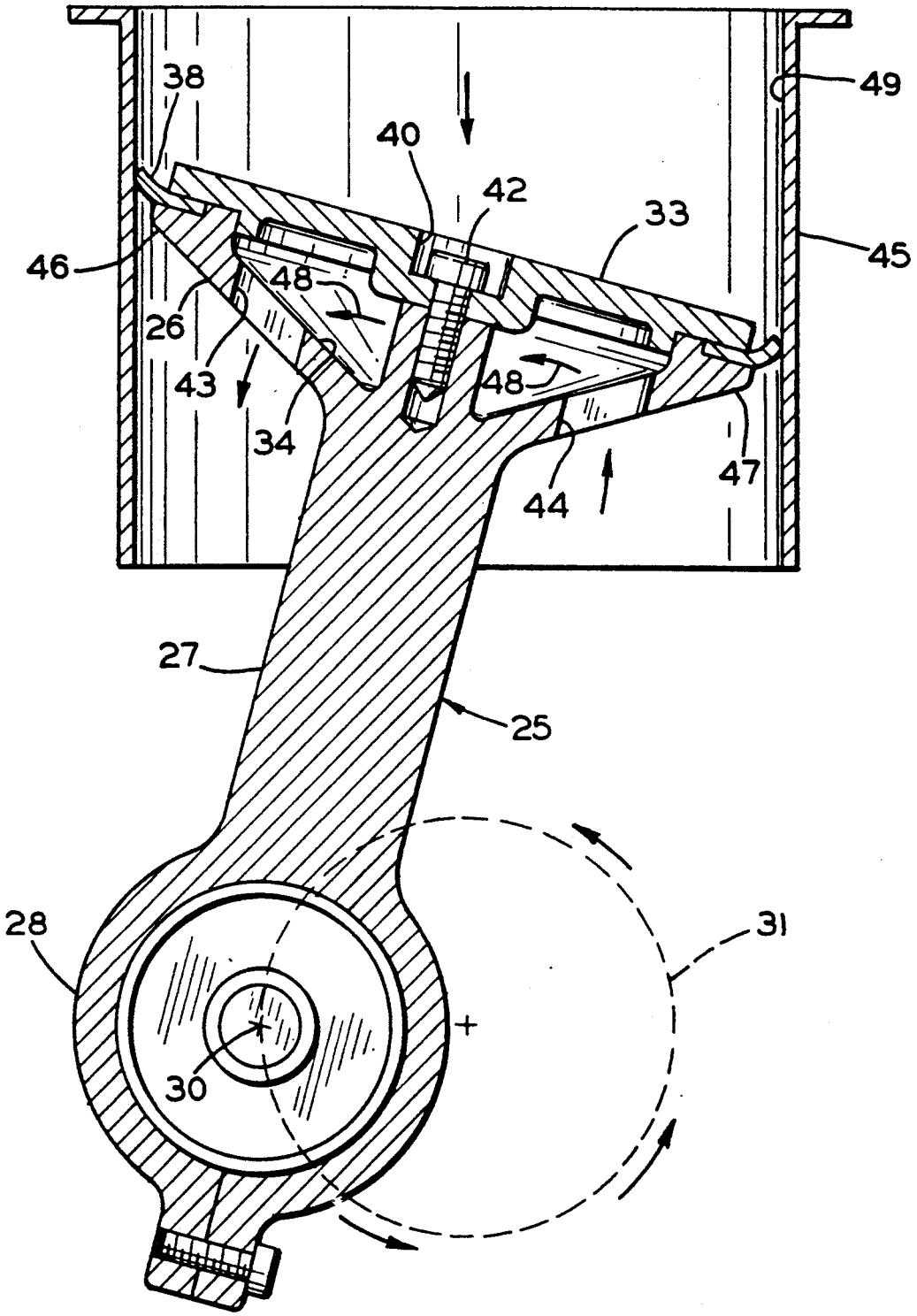
FIG. 4 is an enlarged cross sectional showing the piston of FIG. 2 as it moves and tilts in a cylinder during operation of a compressor.

FIGS. 2–4 show an improved air cooled piston 25 constructed in accordance with the invention. The piston 25 has a head 26 formed integrally with a connecting rod 27. The connecting rod 27 has a free end 28 which mounts a bearing 29 in a conventional manner. The bearing 29 has an axis 30 (extending perpendicular to the drawings in FIGS. 2 and 4) and receives an eccentric (not shown) mounted on a flywheel or on a crankshaft. The eccentric moves the free end so that the axis 30 moves around a circle 31 (FIG. 4).

The piston head 26 is generally conical r cup shaped and has an upwardly opening top edge 32. A cap 33 is positioned on the top edge 32 to define an enclosed chamber 34 in the piston head 26. A rib 35 on a bottom surface 36 of the cap 33 for centering the cap 33 on the piston head 26. An annular groove 37 is formed between the piston head top edge 38 and the cap 33 for retaining an annular piston ring or seal 38. The bottom 39 of a recess 40 in the center of the cap 32 abuts a pillar 41 which extends into the chamber 34. A screw 42 in the recess 40 secures the cap 33 to the pillar 41.

According to the invention, two openings 43 and 44 extend through the head 26 into the chamber 34. The openings 43 and 44 are located on opposite sides of the connecting rod 27 in a plane perpendicular to the axis 30. This location of the openings 43 and 44 causes air to flow through the chamber 34 as the piston 25 is reciprocated.

FIG. 4 illustrates the piston 25 moving in a cylinder 45 as the eccentric moves the free connecting rod end 28 about the circle 31. At the illustrated position, the piston is moving downwardly on an intake or suction stroke and the free connecting rod end 28 has moved 90° about the circle 31 from to dead center. As is illustrated, the piston head 26 tilts or rotates as it is reciprocated in the cylinder 45 so that a side 46 of the piston head 26 adjacent the opening 43 is above a side 47 of the piston head 26 adjacent the opening 44. As the piston 25 moves to the illustrated position, the side 47 will accelerate and move faster than the side 46. Consequently, the air pressure at the opening 44 will be above the air pressure at the opening 43 and air will flow from the opening 44 through the chamber 34 and exit the opening 43 as illustrated by arrows 48. The direction of the air flow through the chamber 34 will change with changes is the relative rotational motion or velocity between the openings 43 and 44. The air flow through the chamber 34 cools the piston cap 33 and the piston head 26 which both reduces the operating temperature of the seal 38 and reduces heat transferred to air in a compression chamber 49 in the cylinder 45 above the piston 25. This both increases the operating life of the seal 38 and increases the volumetric efficiency of the compressor.

It should be appreciated that the locations of the chamber openings 43 and 44 are critical to establishing air flow through the chamber 34. If the openings 43 and 44 were to be located on opposite sides of the connecting rod 27 in a plane parallel to the axis 30, the openings would not rotate relative to one another as the piston head reciprocates. The two openings would always move at the same velocity and the air pressure at the two openings would be balanced throughout the stroke of the piston 25. Consequently, there would be no flow of cooling air through the chamber 34.

It should also be appreciated that the piston 25 may be used in a compressor having other fluid cooling such as oil splash cooling. The air flow through the piston chamber 34 will carry oil droplets through the chamber 34 to enhance cooling to the piston head 26 and the cap 33. It will be appreciated that various modifications and changes may be made to the above described preferred embodiments of a wobble piston without departing from the spirit and the scope of the following claims.

I claim:

1. In a wobble piston of the type having a piston head rigidly connected to a connecting rod, said connecting rod having a free end for movement by an eccentric about a circle, said piston head reciprocating and rotating in a cylinder as said free end is moved, the improvement comprising a chamber formed in said wobble piston head, and at least two openings through said wobble piston head into said chamber, said openings being spaced apart in a plane wherein said openings rotate relative to one another as said piston is reciprocated in a cylinder whereby air is caused to flow through said piston head chamber.

2. An improved wobble piston, as set forth in claim 1, wherein said at least two openings are two openings located in said piston head on opposite sides of said connecting rod.

3. An improved wobble piston, as set forth in claim 2, and including a cap secured to said piston head, said cap closing said chamber.

4. An improved wobble piston, as set forth in claim 3, wherein said piston head is generally conically shaped and has a central pillar, said pillar having a threaded opening, and wherein said cap is secured to said piston head by a screw engaging said threaded opening.

5. An improved wobble piston, as set forth in claim 4, and including an annular seal clamped between said cap and said piston head.

* * * * *